US006550203B1

(12) United States Patent
Little

(10) Patent No.: US 6,550,203 B1
(45) Date of Patent: Apr. 22, 2003

(54) LEAK-PROOF LEAD BARRIER SYSTEM

(75) Inventor: Kenneth D. Little, Brooklyn Park, MN (US)

(73) Assignee: Radiation Protection Products, Inc., Wayzata, MN (US)

( * ) Notice: Subject to any disclaimer, the term of this patent is extended or adjusted under 35 U.S.C. 154(b) by 0 days.

(21) Appl. No.: 09/838,754

(22) Filed: Apr. 19, 2001

(51) Int. Cl.[7] ..... E04B 1/92; G21F 1/08

(52) U.S. Cl. ..... 52/407.4; 52/408; 52/481.1; 52/483.1; 52/238.1; 250/517.1

(58) Field of Search ..... 52/481.1, 483.1, 52/474, 479, 764, 238.1, 775, 408, 424, 407.4; 250/515.1, 571.17

(56) References Cited

U.S. PATENT DOCUMENTS

| | | | | |
|---|---|---|---|---|
| 1,780,108 A | * | 10/1930 | Barry | 109/84 |
| 2,894,463 A | * | 7/1959 | Ferre | 109/82 |
| 4,038,553 A | * | 7/1977 | McCullagh | 250/517.1 |
| 4,074,141 A | * | 2/1978 | Bryant | 250/517.1 |
| 4,628,651 A | * | 12/1986 | Morettin et al. | 52/283 |
| 4,817,355 A | * | 4/1989 | Tilsley et al. | 52/317 |
| 5,092,100 A | * | 3/1992 | Lambert et al. | 52/481.1 |
| 5,740,644 A | * | 4/1998 | Menchetti | 52/281 |
| 5,845,446 A | * | 12/1998 | Funaki et al. | 52/461 |
| 6,145,257 A | * | 11/2000 | Cappuccio | 52/220.2 |

FOREIGN PATENT DOCUMENTS

| | | | |
|---|---|---|---|
| JP | 7-110395 | * | 4/1995 |
| JP | 9-33696 | * | 2/1997 |

* cited by examiner

*Primary Examiner*—Lanna Mai
*Assistant Examiner*—Winnie Yip
(74) *Attorney, Agent, or Firm*—Hugh D. Jaeger

(57) ABSTRACT

A leak-proof lead barrier system to be installed on the interior of metal studs, to be used in conjunction with lead laminated gypsum board. The leak-proof lead barrier system provides an easier and less time-consuming method of sealing a radiation protective room in one step.

3 Claims, 3 Drawing Sheets

LEAK-PROOF LEAD BARRIER SYSTEM

CROSS REFERENCES TO CO-PENDING APPLICATIONS

None.

BACKGROUND OF THE INVENTION

1. Field of the Invention

The present invention is for a leak-proof lead barrier system for use with metal stud framed walls typically installed in X-ray rooms and other areas where radiation protection is needed. The leak-proof lead barrier system utilizes a lead barrier plate secured to the interior of a metal stud before lead-backed gypsum board is installed. The leak-proof lead barrier system can also be adapted for use with header and footer plates.

2. Description of the Prior Art

The current method for creating a leak-proof lead barrier to be used with metal studs and lead laminated gypsum board requires the installer to countersink all the drywall screws into the lead laminated gypsum board when securing the lead laminated gypsum board to metal studs. Once the screws are countersunk, lead screw caps slightly larger than the screw heads are positioned over each and every drywall screw and also countersunk before the seams are taped and finished. In addition to the lead screw caps, a thin strip of sheet lead needs to be installed between the lead portion of the gypsum board and the metal stud where two or more sheets of the lead laminated gypsum board are butted together to prevent leakage at the seam.

The current method requires extensive, time-consuming labor to install, especially at the joints where two or more sheets of lead laminated gypsum board meet. In addition to the time and labor drawbacks, the integrity of the gypsum in the lead laminated gypsum board is compromised due to countersinking the screws and the use of lead screw caps, which causes the gypsum to crack and crumble.

The present invention addresses and corrects all of the previously mentioned shortcomings and will be described in detail in the preferred embodiment.

SUMMARY OF THE INVENTION

The general purpose of the present invention is to provide a leak-proof lead barrier system to be used in conjunction with lead laminated gypsum board.

According to one embodiment of the present invention, there is provided a lead barrier plate, including a mounting portion and a barrier portion, which is appropriately secured to the interior of a metal stud prior to installing lead laminated gypsum board. This lead barrier plate provides a lead barrier where holes are created in the lead backing of the lead laminated gypsum board when it is screwed onto the metal studs and where two or more sheets of the lead laminated gypsum board meet, eliminating the need for lead screw caps and strips of sheet lead at seams.

One significant aspect and feature of the present invention is an angled lead barrier plate which mounts to the interior of a metal stud.

Another significant aspect and feature of the present invention is one-step installation of the leak-proof lead barrier plate.

Still another significant aspect and feature of the present invention is elimination of lead screw caps which compromise the integrity of the gypsum board.

Yet another significant aspect and feature of the present invention is elimination of lead sheet metal applied to the interior seam of two or more lead laminated gypsum boards.

A further significant aspect and feature of the present invention is that thickness of the lead barrier plate may be changed to accommodate the needs of the user without affecting form or function.

Having thus enumerated significant aspects and features of the present invention, it is the principal object of the present invention to provide a leak-proof lead barrier system to be used with lead laminated gypsum board and metal studs.

One object of the present invention is to provide a leak-proof lead barrier system which can be installed in one step.

Another object of the present invention is to provide a leak-proof lead barrier system which does not require lead screw caps.

Yet another object of the present invention is to provide a leak-proof lead barrier system which does not require additional lead sheeting where two or more lead laminated gypsum boards meet.

Still another object of the present invention is to provide a means of creating a leak-proof lead barrier system which will not compromise the integrity of the lead laminated gypsum board.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
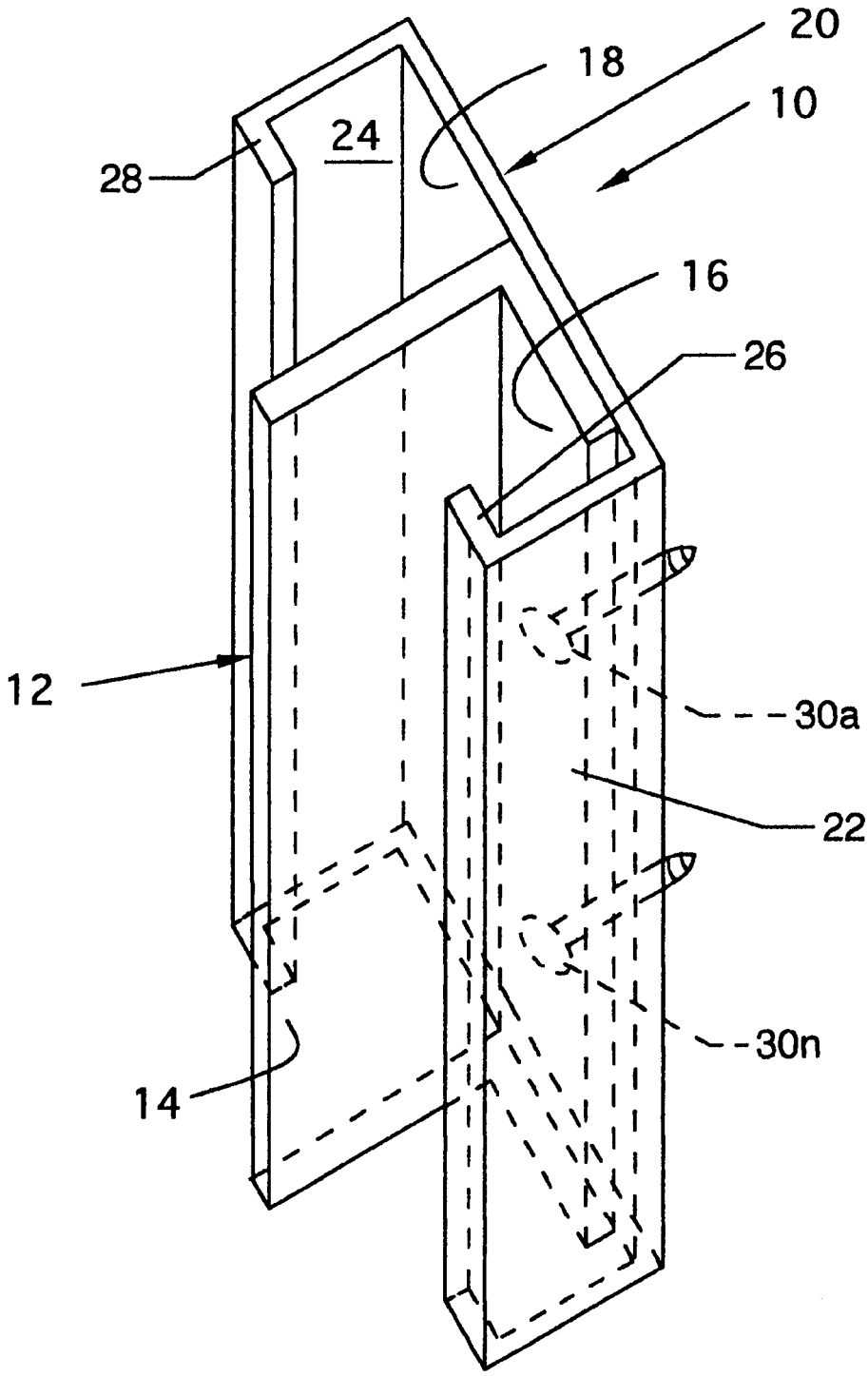
FIG. 1 illustrates an isometric view of a leak-proof lead barrier system, the present invention.

FIG. 1 illustrates an isometric view of a leak-proof lead barrier system 10, the present invention. The leak-proof lead barrier system 10 is created by vertically aligning and securing an angled lead barrier plate 12, having a mounting portion 16 and a barrier portion 14, to the interior of the central planar portion 18 of a metal stud 20. The lead barrier plate 12 is secured to the metal stud 20 by a plurality of sheet metal screws 30*a*–30*n* which pass through the mounting portion 16 of the lead barrier plate 12 and into the central planar portion 18 of the metal stud 20. It is to be understood that other appropriate means of securement may be used such as, but not limited to, welding, extrusion or metal adhesive. In the illustrated case, the number of sheet metal screws 30*a*–30*n* is dependent on the height of the metal stud 20. Each metal stud 20 has a front planar portion 22 and a rear planar portion 24 which extend outwardly from central planar portion 18, and flanges 26 and 28 extend inwardly from the front planar portion 22 and rear planar portion 24, as illustrated.

The purpose and use of the leak-proof lead barrier system 10 will become visibly apparent when lead laminated gypsum boards are secured to either the front planar portion 22 (FIG. 2), the rear planar portion 24 (not illustrated) or both planar portions 22 and 24 (not illustrated) of the metal stud 20.

Figure 2:
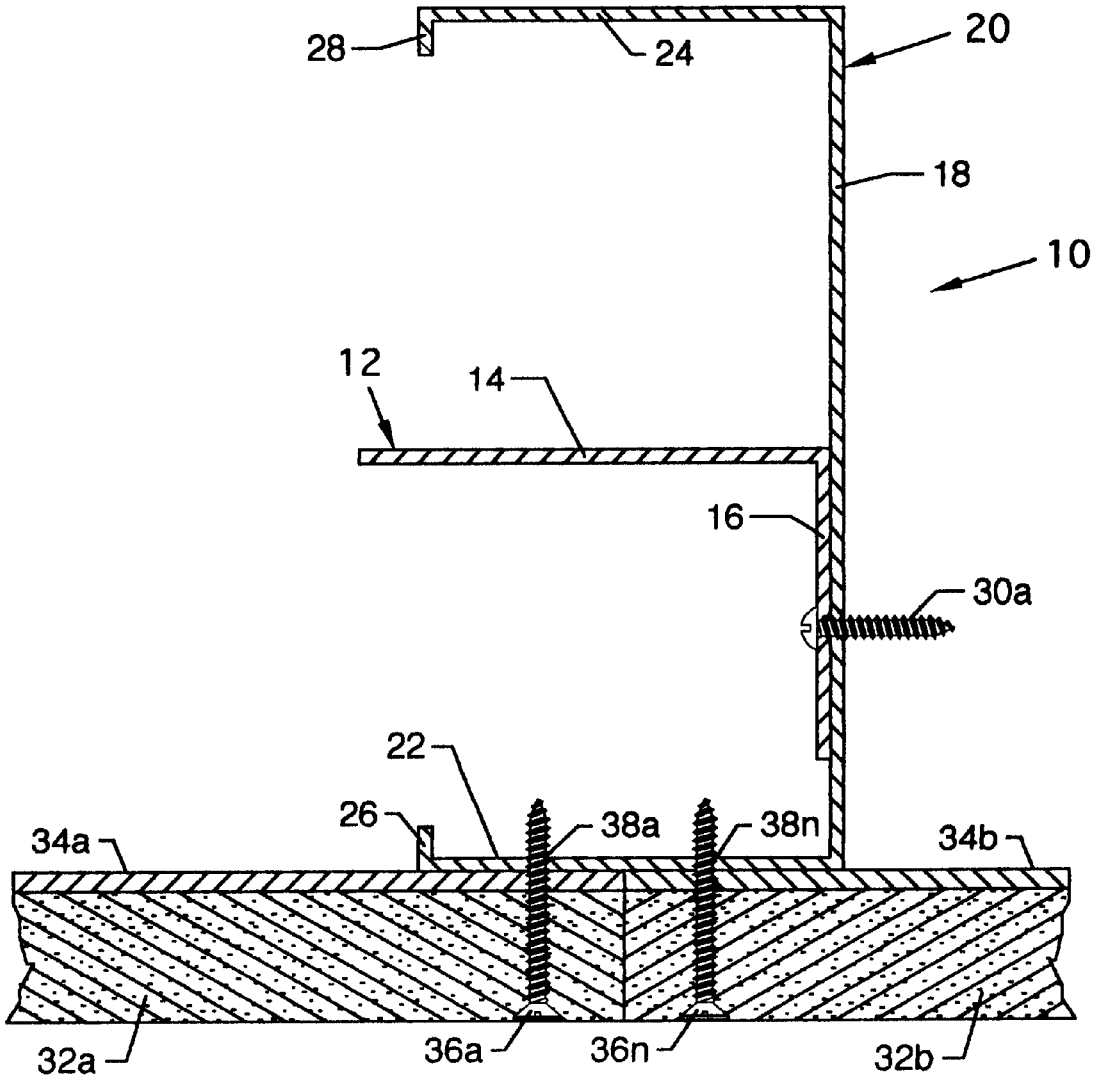
FIG. 2 illustrates a top cross-sectional view of the leak-proof lead barrier system; and, FIG. 3 illustrates a top cross-sectional view of the prior art method of creating a leak-proof lead barrier system.

FIG. 2 illustrates a top cross-sectional view of the leak-proof lead barrier system 10. The lead barrier plate 12 is mounted to the metal stud 20 as described in FIG. 1. Illustrated in particular are two lead laminated gypsum boards 32*a* and 32*b*, each having a lead portion 34*a* and 34*b*, respectively, and oriented in abutting fashion. The juncture where the lead laminated gypsum boards 32*a* and 32*b* meet is centrally aligned along the front planar portion 22 of the metal stud 20 where a plurality of drywall screws 36*a*–36*n* secure the lead laminated gypsum boards 32*a* and 32*b* to the metal stud 20. Once again, the number of drywall screws 36*a*–36*n* needed is dependent on the height of the lead laminated gypsum boards 32*a* and 32*b* and metal stud 20.

Once the lead laminated gypsum boards 32*a* and 32*b* are appropriately secured to the front planar portion 22 of metal stud 20, it becomes apparent that holes 38*a*–38*n* are created in the lead portions 34*a* and 34*b* of the lead laminated gypsum boards 32*a* and 32*b*, creating leaks. Due to the fact that gamma rays, including X-rays, only travel in a straight line, the barrier portion 14 of the lead barrier plate 12 extends beyond flanges 26 and 28, the holes 38*a*–38*n*, and the juncture where lead laminated gypsum boards 32*a* and 32*b* abut. Thus, a leak-proof lead barrier system 10 is created without lead screw caps being installed over each screw or a narrow strip of sheet lead being installed at the seams, as shown in the prior art illustration of FIG. 3.

Figure 3:
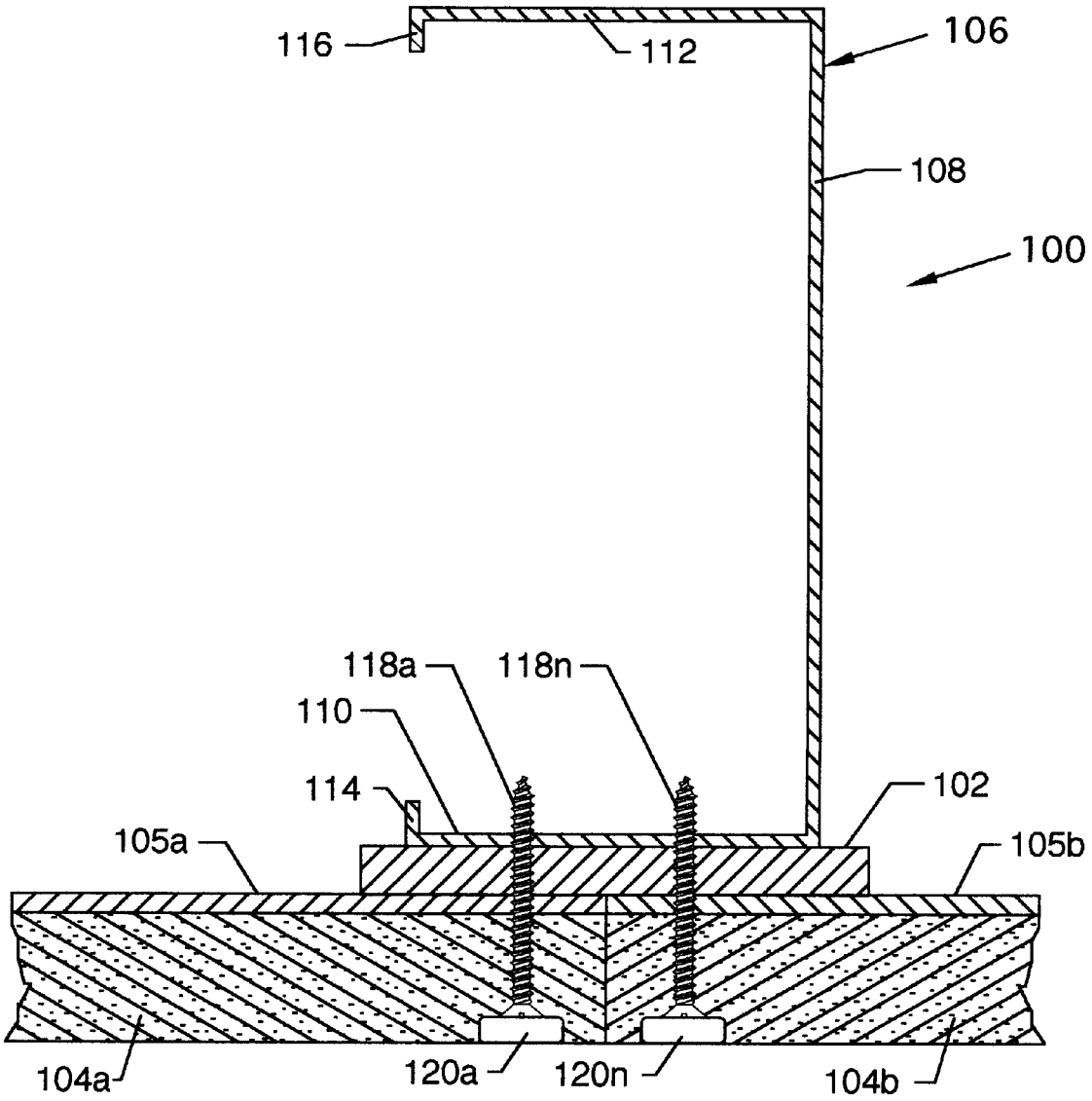
FIG. 3 PRIOR ART

FIG. 3 illustrates a top cross-sectional view of the prior art method of creating a leak-proof lead barrier system 100, having lead laminated gypsum boards 104*a* and 104*b*, each having a lead portion 105*a* and 105*b*, a metal stud 106, and drywall screws 118*a*–118*n* identical to those previously described. The metal stud 106 is comprised of a central planar portion 108, a front planar portion 110, a rear planar portion 112 and two flanges 114 and 116. Illustrated in particular is a sheet lead strip 102 which is positioned between lead portions 105*a* and 105*b* of the lead laminated gypsum boards 104*a* and 104*b* and metal stud 106 and secured in place by drywall screws 118*a*–118*n* which are countersunk into lead laminated gypsum boards 104*a* and 104*b*. The sheet lead strip 102 provides leak protection where lead laminated gypsum boards 104*a* and 104*b* abut, and lead screw caps 120*a*–120*n* are installed over each drywall screw 118*a*–118*n* and countersunk to provide leak protection for the holes created by the drywall screws 118*a*–118*n*. By countersinking both the drywall screws 118*a*–118*n* and the lead screw caps 120*a*–120*n*, the gypsum layers of the lead laminated gypsum boards 104*a* and 104*b* typically crack and crumble, compromising the integrity of the entire sheets.

The present invention provides an easy one-step application which is less labor intensive, less time consuming and does not compromise the integrity of the gypsum in the lead laminated gypsum boards.

Various modifications can be made to the present invention without departing from the apparent scope hereof.

LEAK-PROOF LEAD BARRIER SYSTEM
PARTS LIST

| | |
|---|---|
| 10 | leak-proof lead barrier system |
| 12 | lead barrier plate |

-continued

LEAK-PROOF LEAD BARRIER SYSTEM
PARTS LIST

| | |
|---|---|
| 14 | barrier portion |
| 16 | mounting portion |
| 18 | central planar portion |
| 20 | metal stud |
| 22 | front planar portion |
| 24 | rear planar portion |
| 26 | flange |
| 28 | flange |
| 30a–n | sheet metal screws |
| 32a–b | lead laminated gypsum boards |
| 34a–b | lead portions |
| 36a–n | drywall screws |
| 38a–n | holes |
| 100 | leak-proof lead barrier system |
| 102 | sheet lead strip |
| 104a–b | lead laminated gypsum boards |
| 105a–b | lead portions |
| 106 | metal stud |
| 108 | central planar portion |
| 110 | front planar portion |
| 112 | rear planar portion |
| 114 | flange |
| 116 | flange |
| 118a–n | drywall screws |
| 120a–n | lead screw caps |

It is claimed:

1. A wall construction for use in x-ray rooms and other areas where radiation protection is needed, comprising: a plurality of sheets of lead-backed gypsum board butted together and thereby defining a seam; a metal stud comprising a channel member formed of a planar base and two planar legs extending perpendicularly from said planar base along opposite edges of said planar base and in the same direction from said planar base, one of said two planar legs spanning said seam, extending along the length of said seam, and being fastened to said sheets of lead-backed gypsum board on opposite sides of said seam; and an L-shaped lead barrier member located within said channel member, said L-shaped lead barrier member having a planar mounting portion attached to said planar base of said channel member and a planar barrier portion projecting from said planar mounting portion at a right angle thereto in a same direction as said two planar legs and extending over said seam, thereby providing a barrier to any radiation passing through said seam.

2. The leak-proof lead barrier system according to claim 1, herein said planar mounting portion of said L-shaped lead barrier member is attached to said planar base of said channel member by sheet metal screws.

3. The leak-proof lead barrier system according to claim 1, wherein said planar barrier portion of said L-shaped lead barrier member extends outwardly from said planar base of said channel member a distance greater than the distance which said two planar legs extend from said planar base.

* * * * *